US007434320B2

(12) United States Patent
Aston, III

(10) Patent No.: US 7,434,320 B2
(45) Date of Patent: Oct. 14, 2008

(54) BLADE GRIP FOR A KNIFE AND METHOD OF USE

(76) Inventor: Walter Mathew Aston, III, 6946 Alcove Ave., North Hollywood, CA (US) 91605

( * ) Notice: Subject to any disclaimer, the term of this patent is extended or adjusted under 35 U.S.C. 154(b) by 128 days.

(21) Appl. No.: 11/260,024

(22) Filed: Oct. 26, 2005

(65) Prior Publication Data

US 2006/0179665 A1 Aug. 17, 2006

Related U.S. Application Data

(60) Provisional application No. 60/593,843, filed on Feb. 17, 2005.

(51) Int. Cl.
*B26B 29/02* (2006.01)

(52) U.S. Cl. ..... 30/295; 30/296.1

(58) Field of Classification Search ..... 30/286, 30/296, 296.1, 298, 295; 24/30.5 R, 30.5 P, 24/501, 561; 224/247; 8/395
See application file for complete search history.

(56) References Cited

U.S. PATENT DOCUMENTS

| | | | | |
|---|---|---|---|---|
| 492,409 | A | 2/1893 | May | |
| 649,059 | A | 5/1900 | Kern | |
| 673,506 | A | 5/1901 | Pitts | |
| 682,938 | A | 9/1901 | Ingram | |
| 734,909 | A | 7/1903 | MacLean | |
| 1,491,623 | A | 4/1924 | Pitchur | |
| 1,505,444 | A | 8/1924 | Swanson | |
| 1,750,577 | A | 3/1930 | De Bracht | |
| 2,168,237 | A | 8/1939 | Polacsek | |
| 2,217,100 | A | 10/1940 | Burns | |
| D131,224 | S | 1/1942 | Parisi | |
| 2,494,306 | A | 1/1950 | Morvey | |
| 2,533,539 | A * | 12/1950 | Stewart | 24/561 |
| 2,650,424 | A | 9/1953 | Kalmon | |

(Continued)

FOREIGN PATENT DOCUMENTS

| | | |
|---|---|---|
| JP | 11-347262 | 12/1999 |

(Continued)

OTHER PUBLICATIONS

"Hold a Knife With a Proper Grip," 1 page printed from website at www.cutlery.com on Oct. 10, 2005.

(Continued)

*Primary Examiner*—Hwei-Siu C. Payer
(74) *Attorney, Agent, or Firm*—Fulwider Patton LLP

(57) ABSTRACT

An elongate blade grip is attached to the top edge of a knife blade to achieve greater cutting control and efficiency. The blade grip includes a top member and two opposing side members connected to the top member. The blade grip closely conforms to the flat shape of the knife blade so as to allow knife users to choke up on the knife, or hold the knife partly by the blade. An elongate and rounded top surface on the top member relieves pressure on the proximal phalange of the index finger, thereby reducing blisters and calluses associated with choking up. The side members of the blade grip include slip resistant surfaces where the thumb and medial phalange of the index finger are normally located when choking up on the knife.

19 Claims, 5 Drawing Sheets

U.S. PATENT DOCUMENTS

| | | | | | |
|---|---|---|---|---|---|
| D255,974 | S | | 7/1980 | Jacoby | |
| 4,356,754 | A | * | 11/1982 | Fishman | 84/731 |
| 4,587,735 | A | | 5/1986 | Walters et al. | |
| 4,932,604 | A | | 6/1990 | Maehara et al. | |
| 4,937,941 | A | | 7/1990 | Crist | |
| D391,115 | S | | 2/1998 | Roberton | |
| D397,282 | S | | 8/1998 | Derkatz | |
| 5,843,107 | A | | 12/1998 | Landis et al. | |
| 6,105,217 | A | * | 8/2000 | Caradine et al. | 24/501 |
| D445,643 | S | | 7/2001 | Kazaklaris | |
| 6,381,855 | B1 | | 5/2002 | Lin | |
| D461,681 | S | | 8/2002 | Lothe | |
| D514,435 | S | * | 2/2006 | Bhavnani | D8/395 |
| 2002/0170184 | A1 | | 11/2002 | Lothe | |
| 2004/0123471 | A1 | | 7/2004 | Onion | |

FOREIGN PATENT DOCUMENTS

| | | |
|---|---|---|
| JP | 2003-236265 | 8/2003 |

OTHER PUBLICATIONS

"Identify Basic Knife Parts," 3 pages printed from website at www.cutlery.com on Oct. 10, 2005.
"Chef'sChoice.com Basic Tips," 2 pages printed from website at www.edgecraft.com Oct. 10, 2005.
Koetke, "Chef Knives-How to really use them," 2 pages printed from website at www.cheftalk.com on Oct. 10, 2005.
"Basic Knife Techniques," Cook's Illustrated, Jan./Feb. 1996, pp. 16 and 17.

* cited by examiner

FIG. 1
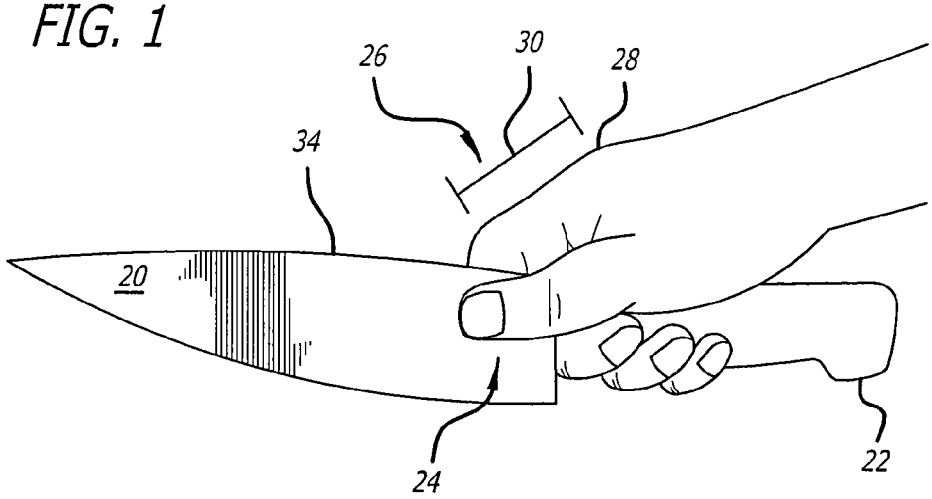
PRIOR ART
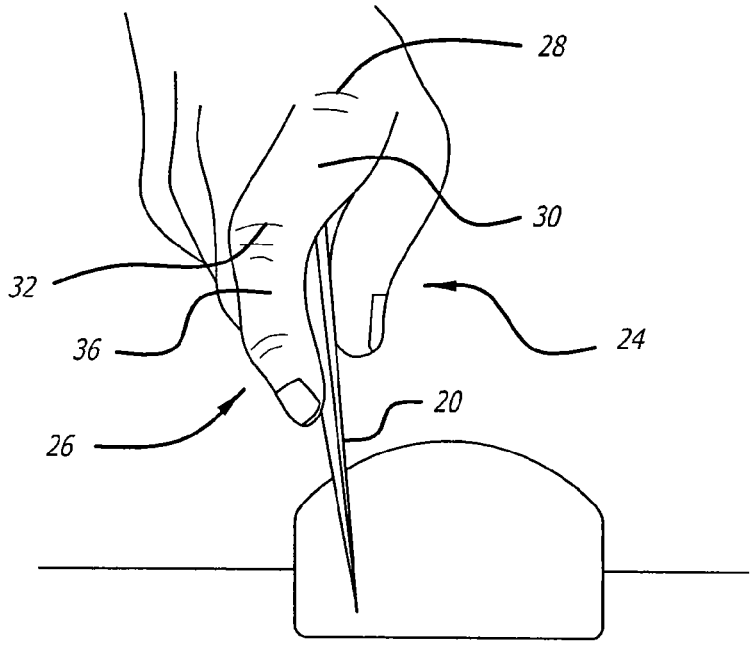
FIG. 2
PRIOR ART

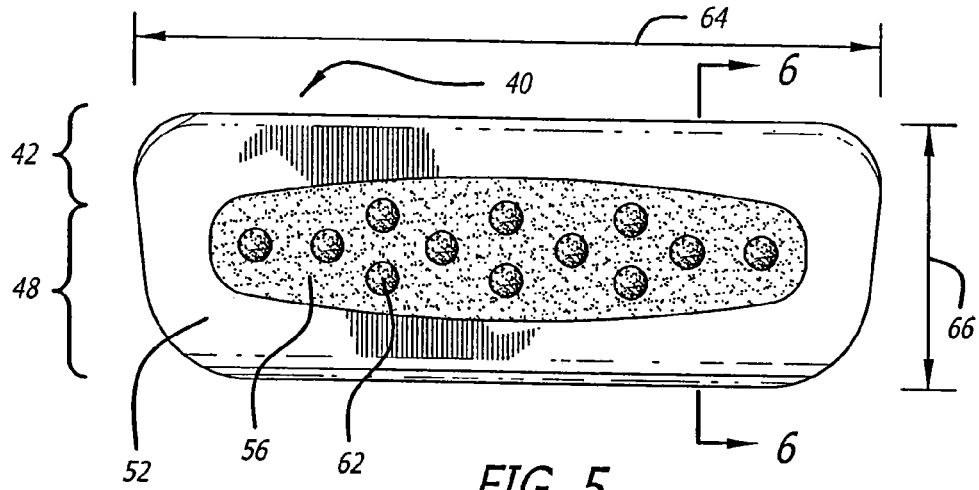
FIG. 5
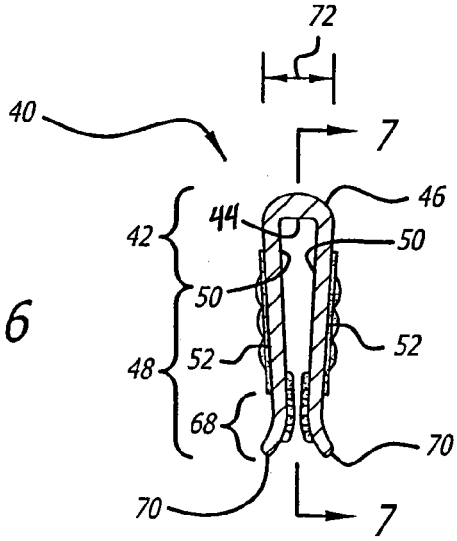
FIG. 6
FIG. 7
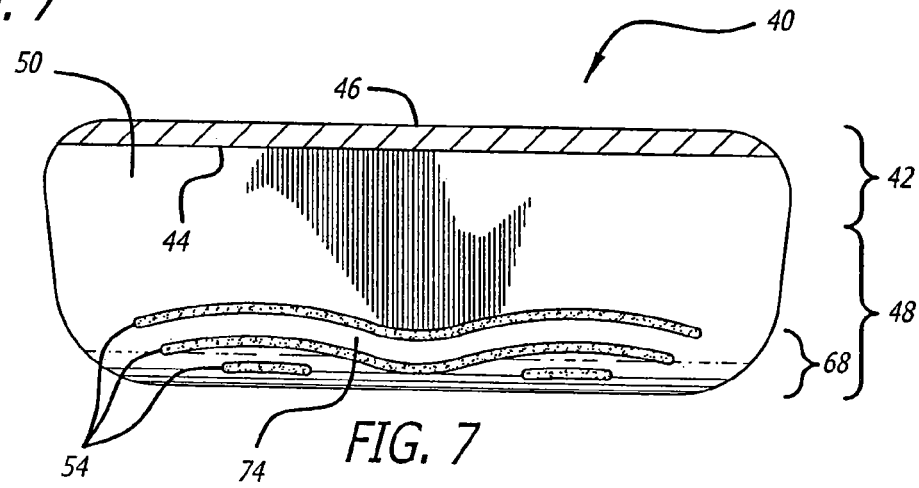
FIG. 7

BLADE GRIP FOR A KNIFE AND METHOD OF USE

CROSS-REFERENCE TO RELATED APPLICATION

This application depends for priority upon U.S. Provisional Patent Application No. 60/593,843, filed Feb. 17, 2005, which is herein incorporated by reference in its entirety.

FIELD OF THE INVENTION

The present invention relates generally to the field of hand-held cutting tools and, more particularly, to grips for cutlery.

BACKGROUND OF THE INVENTION

It is common practice for professional chefs and cooks to hold larger knives, such as an eight-inch or ten-inch chef's knife, with one hand on a portion of the knife blade 20 and on a portion of the adjacent knife handle 22, as shown on FIGS. 1 and 2. The knife blade is pinched on both sides by the thumb 24 and index finger 26 while the ring finger, middle finger, and outermost finger curl under the handle. The other hand is then free to hold a work piece, with fingers often curled and knuckles guiding the knife blade. This technique of holding a knife, referred to herein as "choking up," has several advantages over simply holding a knife with all four fingers and thumb only on the handle.

The need to prepare food quickly, efficiently, and safely is important in professional and home kitchens. To increase efficiency, culinary workers often prefer to use one large knife to cut small and large work pieces rather than use several knives of different sizes or configurations. This avoids having to find a particular knife and to change from one knife to another, thereby allowing culinary workers to move quickly from one task to the next. However, small work pieces often require more precise cutting, which requires increased control of a knife. Choking up allows culinary workers to increase control over a large knife to achieve precise cuts on small work pieces. Even on large work pieces, choking up allows for better control of cutting angles since the blade sides are stabilized by the thumb and index finger, which are typically a person's two strongest digits. Also, culinary workers with larger hands may find it difficult to comfortably fit all four fingers under the knife handle and, thus, may need to choke up on the knife blade.

When properly choking up on a knife, the knuckle or metacarpophalangeal joint 28 of the index finger is positioned above the interface between the knife blade and knife handle. The proximal phalange of the index finger 30, which is between the metacarpophalangeal joint and proximal interphalangeal joint 32, extends over the top edge 34 of the knife blade so that the medial phalange 36 of the index finger presses against one side of the blade to counterbalance pressure applied by the thumb on the other side of the blade. As such, the proximal phalange of the index finger normally experiences significant pressure from the top edge of the knife blade. The pressure increases at the abrupt ninety-degree corners where the horizontal surface of the top edge meets the sides of the knife blade. As such, repeatedly choking up on a knife often causes a blister to form on the proximal phalange of the index finger, which eventually hardens into a large callous, often referred to as a knife callous or chef's callous.

Many people do not choke up, holding a large knife only by the knife handle 22 because they have not been taught how to choke up in order to achieve better control. Also the knife handle, which is often rounded and ergonomically shaped, serves as a visual cue that discourages many people from placing their thumb and index finger on the sides of the knife blade. Even when people are shown how to choke up, the uncomfortable feel of the smooth, hard surface of the knife blade and the pain from blisters that begin to form on the proximal phalange of the index finger discourage many people from continuing to choking up on a knife.

Prior devices to facilitate use of a knife involve platforms for resting a thumb or tip of the index finger on the top edge of a knife blade in order to force a knife downwards. However, pressing the top edge of a large knife blade with a thumb finger tip is undesirable in many situations, such as when precise control of cutting angle is required. In addition, it is often more efficient and easer to cut a work piece using a forward slicing motion rather than relying on a downward force. Thus, these prior art devices and methods fail to promote choking up on a knife in the proper manner.

Other prior devices to facilitate use of a knife involve protruding handles and knobs. These protruding handles and bulbous knobs do not allow the proximal phalange of the index finger to extend over the top edge of the blade so that the medial phalange 36 of the index finger, not just the finger tip, push against one side of the blade to counterbalance pressure applied by the thumb on the other side of the blade.

Thus, there is an unsatisfied need for an improved method and a device that teaches, aids and encourages persons to properly choke up on a knife in order to achieve better safety through increased control of the knife, while simultaneously relieving discomfort caused by blisters and calluses associated with choking up. Such a method and device would increase efficiency and safety in commercial and non-commercial kitchens alike. The present invention satisfies this and other needs.

SUMMARY OF THE INVENTION

One aspect of the present invention is a blade grip to be installed onto the top edge of a knife blade, the top edge extending distally from a knife handle in a longitudinal direction. The blade grip comprises an elongate top member having a top inner surface adapted to rest on the top edge of the knife blade and a top outer surface that is rounded in a transverse direction perpendicular to the longitudinal direction and is substantially coincident with the top edge of the knife blade; and two opposing side members extending longitudinally and connected to the top member, the side members each having a side inner surface adapted to grip one side of the knife blade and a side outer surface extending downward from the top outer surface of the top member, the side inner surface including a slip resistant inner surface and the side outer surface including a slip resistant outer surface, the slip resistant inner and outer surfaces having a higher coefficient of friction than other surfaces on the side members.

One embodiment of the present invention include at least one protrusion on the slip resistant outer surface. Another embodiment includes at least one groove on the slip resistant inner surface.

In other aspects of the present invention, the top member and the side members form a transverse cross-sectional shape substantially having an inverted "u" shape with an opening adjacent bottom portions of the side members. The cross-sectional shape preferably has a substantially uniform wall thickness. The bottom portions are adapted to exert a compressive force on the knife blade in other aspects.

In other embodiments of the present invention, the side outer surface of at least one side member includes a chamfer extending longitudinally along a substantial length of the side member, and the side inner surface of the at least one side member includes a flared corner area.

Another aspect of the present invention includes at least of the side members with a length dimension in the longitudinal direction and a height dimension perpendicular to the length dimension, and the ratio of the length dimension to the height dimension being at least about 3 to 1.

In yet another aspect, at least one of the side members has a length dimension in the longitudinal direction and the top member has a width dimension perpendicular to the length direction, the ratio of the length dimension to the width dimension being at least about 8 to 1.

In another aspect of the present invention, the top member has a substantially uniform wall thickness. The side members have substantially uniform wall thicknesses in other aspects.

Other aspects of the present invention have the top member with a width dimension perpendicular to the longitudinal direction, the width dimension being substantially uniform along the longitudinal direction. The side outer surfaces are substantially parallel to each other in other aspects.

In other aspects, the top member has a top length dimension and the side members have side length dimensions, the top length and side length dimensions being parallel to the longitudinal direction and sufficient to allow the proximal phalange of an index finger to wrap over the top outer surface and allow the medial phalange of the index finger to press against the side outer surface extending downward from the top outer surface of the top member. In yet other aspects, the top member has a width dimension perpendicular to the longitudinal direction, the width dimension being limited so as to allow the proximal phalange of an index finger to remain substantially parallel to the longitudinal direction while wrapping over the top outer surface of the top member.

Another aspect of the present invention is a method of controlling a knife by attaching a blade grip onto the knife blade, the blade grip including a top member and two opposed side members having side outer surfaces and side inner surfaces defining a longitudinal slot, including pushing the blade grip onto the top edge of the knife blade such that the top edge of the knife blade enters the longitudinal slot and rests upon the top member of the blade grip; and grasping the knife with one hand, including wrapping the proximal phalange of the index finger over a rounded top surface of the top member, squeezing the side outer surfaces of the side members between the medial phalange of the index finger and the distal phalange of the thumb, the side outer surfaces extending downward from the curved top surface of the top member.

In further aspects, attaching the blade grip on to the knife blade includes positioning the blade grip along the top edge of the knife blade such that it blade grip is adjacent the knife handle.

In another aspect, attaching the blade grip on to the knife blade includes positioning slip resistant portions on the side outer surfaces where the medial phalange of the index finger and the distal phalange of the thumb squeeze the side members of the blade grip.

The features and advantages of the invention will be more readily understood from the following detailed description which should be read in conjunction with the accompanying drawings.

BRIEF DESCRIPTION OF THE DRAWINGS

FIG. 1 is side view of a knife without a blade grip showing a hand holding the knife such that the knife blade is pinched on both sides by the thumb and index finger while the ring finger, middle finger, and outermost finger curl under the knife handle;

FIG. 2 is an end view of a knife without a blade grip showing a hand holding the knife such that the proximal phalange of the index finger extends over the top edge of the knife blade so that other portions of the index finger press against one side of the blade to counterbalance pressure applied by the thumb on the other side of the blade;

FIG. 5 is side view of the blade grip of FIG. 4, showing a major and minor dimension of the blade grip and showing a top outer surface of the top member and a side outer surface of one of the side members, the side outer surface including a slip resistant surface with a plurality of circular protrusions;

FIG. 6 is a cross-sectional view of the blade grip of FIG. 5 along line 6-6, showing a substantially, inverted u-shaped cross-sectional, the top outer surface of the top member being rounded and defining a width dimension, the side outer surfaces of the side members extending downward from the top outer surface, and bottom portions of the side portions including flared lips;

FIG. 7 is a cut-away view of the blade grip of FIG. 6 along line 7-7, showing a side inner surface of one of the side members, the side inner surface including a slip resistant surface with a plurality of grooves, the slip resistant surface disposed about the bottom portion of the side member.

DETAILED DESCRIPTION OF THE PREFERRED EMBODIMENTS

Figure 3:
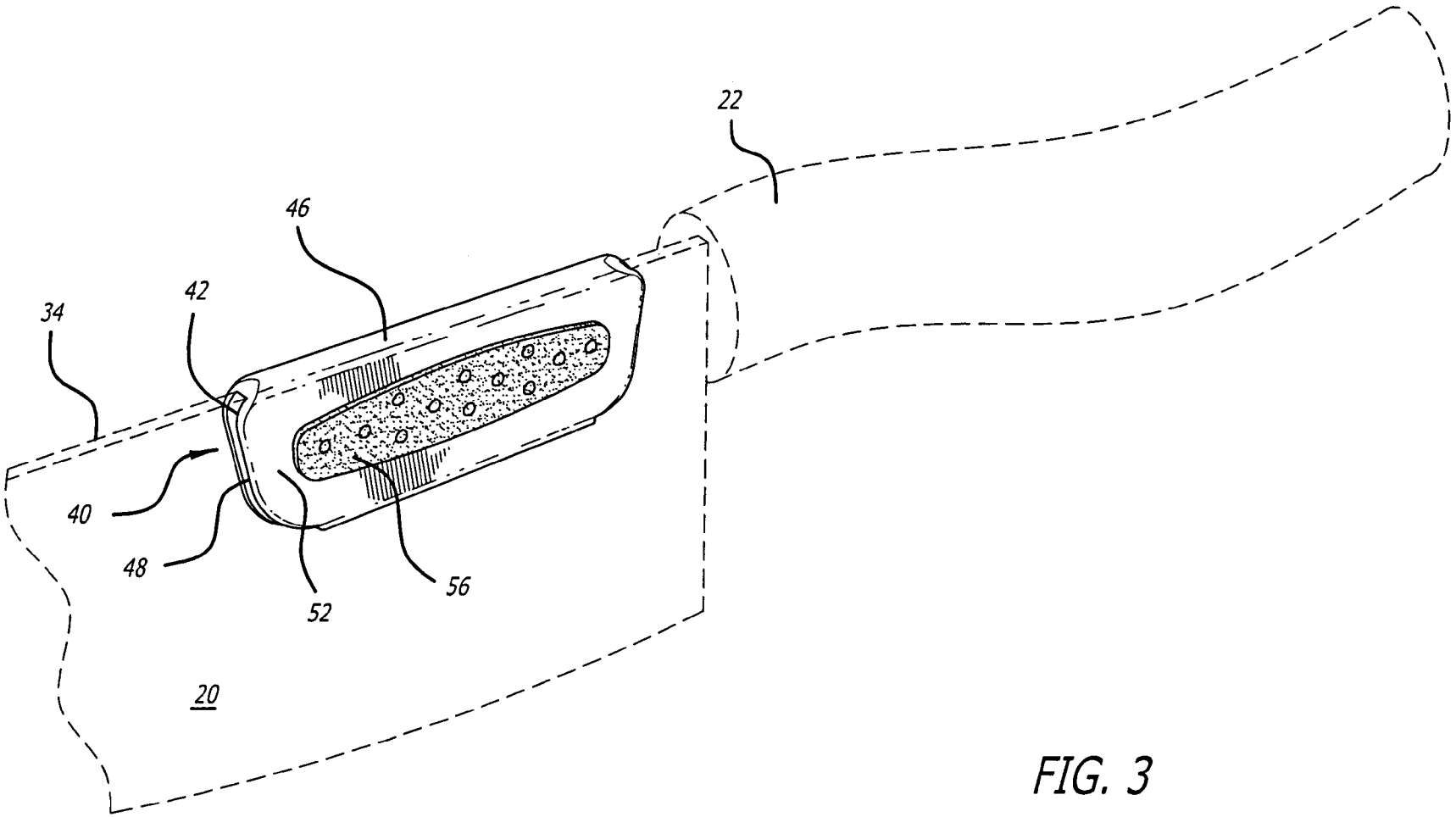
FIG. 3 is a top perspective view of a blade grip in accordance with an embodiment of the present invention, showing an elongate top member and two opposing side members extending along a longitudinal direction, and showing the top member disposed on the knife blade's horizontal top edge and the side members disposed on the knife blade's vertical sides.

Referring now in more detail to the exemplary drawings, wherein like reference numerals designate corresponding or like elements among the several views, there is shown in FIG. 3 a blade grip 40 attached to a knife blade 20. The blade grip includes an elongate top member 42 a top inner surface 44 (FIGS. 6 and 7) and a rounded top outer surface 46. The blade grip also includes two opposed side members 48 that extend along the length of and are connected to the top member. Each of the side members has a side inner surface 50 and a side outer surface 52, which include a slip resistant inner surface 54 (FIG. 7) and a slip resistant outer surface 56, respectively. The outer surface extends smoothly in a downward direction from the top outer surface of the top member.

To attach the blade grip 40 to the knife blade 20, the blade grip is pushed onto the top edge 34 of the knife such that the top edge enters a longitudinal slot between the side members 48 until the top inner surface 44 rests on the top edge. The knife is illustrated in broken lines to better show both sides of the blade grip. The top edge of the knife extends distally from the knife handle 22 in a longitudinal direction indicated as arrow 58. Preferably, the blade grip is positioned along the top edge such that the blade grip is adjacent to the knife handle in order to facilitate choking up. The side inner surface 52 of each of the side members 48 are adapted to grip one side of the knife blade to prevent the blade grip from shifting longitudinally or upward while cutting a work piece.

Preferably, the overall shape of the blade grip 40 conforms closely to the knife blade 20 so to avoid interfering with the balance and function of the knife and with a user's view of a work piece. The top member 42 is preferably thin such that its top outer surface 46 is almost flush or substantially coincident with the top edge of the knife blade. The top member and side members 48 are also preferably thin walled with substantially uniform wall thickness, as described in greater detail below.

Figure 4:
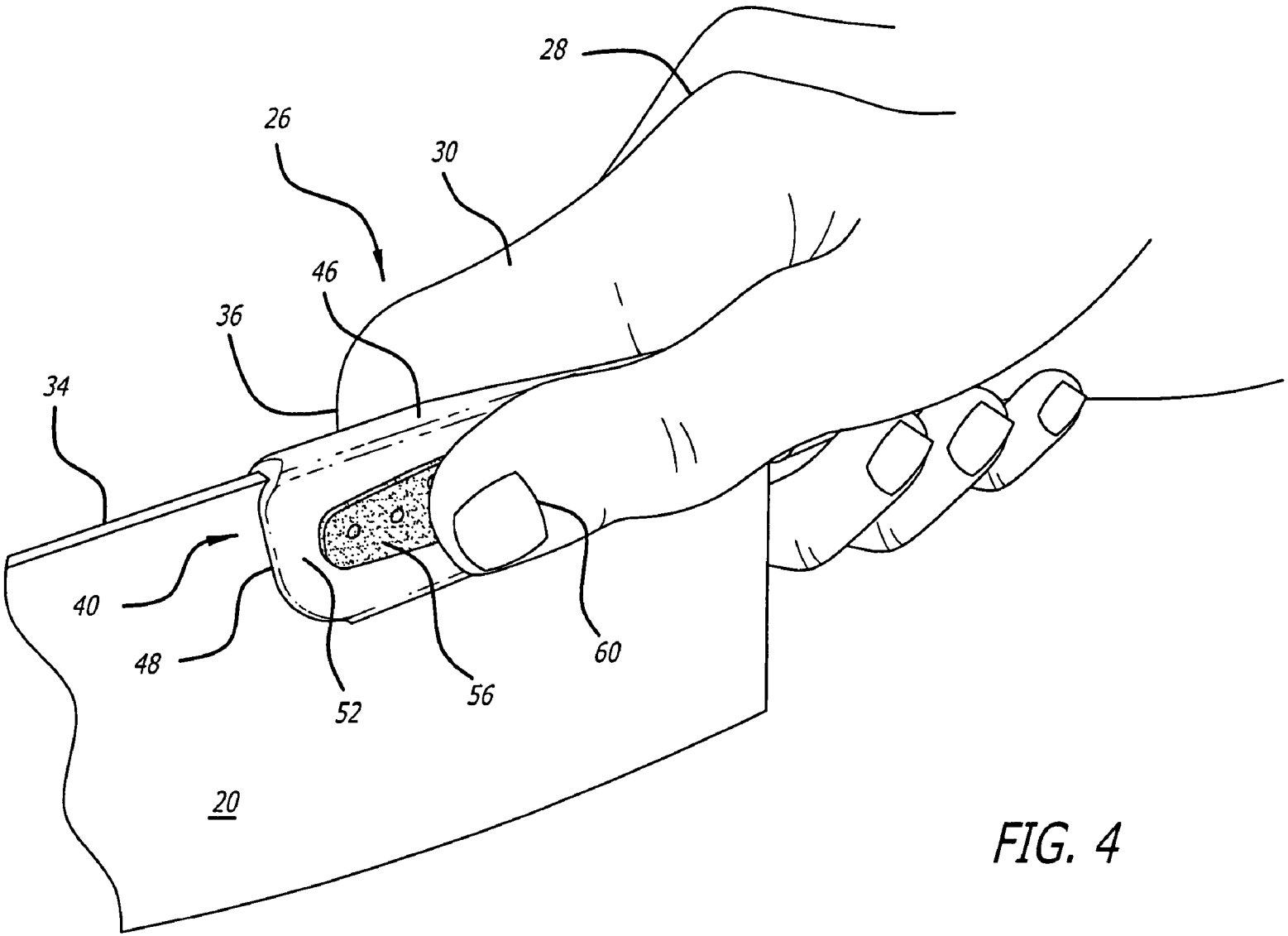
FIG. 4 is a top perspective view of the blade grip being used to choke up on a knife such that that the proximal phalange of the index finger extends over the top member of the blade grip so that other portions of the index finger press against one side member of the blade grip to counterbalance pressure applied by the thumb on the other side member of the blade grip.

FIG. 4 shows the blade grip 40 being used to grasp the knife with one hand using the choking up technique previously described. The orientation and position of the thumb and fingers is guided by the blade grip attached on the knife. As such, professional culinary workers and others who are accustomed to choking up will be comfortable using the blade grip. As illustrated, the proximal phalange 30 of the index finger 26 is wrapped over the top outer surface 46 of the top member 42, which allows the medial phalange 36 of the index finger to drop to one side of the top member. Because the top outer surface 46 of the top member is rounded, pressure on the proximal phalange is substantially reduced compared to when the blade grip 40 is not installed and the proximal phalange makes contact with the abrupt comers at the top edge of the knife. Thus, blisters and calluses associated with choking up are reduced with use of the blade grip. When cutting a work piece, the side outer surfaces 52 of the side members 48 are squeezed between the medial phalange of the index finger and the distal phalange 60 of the thumb. In this way, the cutting angle of the knife blade can be well controlled.

The rounded shape of the top member does not provide a flat or wide platform in order to discourage placement of a thumb or tip of the index finger on top of the knife blade 20, which is undesirable for controlling cutting angle. With a thumb or finger tip on the top of the knife blade, there is also an undesirable tendency for users to cut a work piece with a mostly downward motion. A more efficient cutting method involves moving the knife blade in a longitudinally slicing motion across the work piece, which is encouraged and facilitated by the blade grip 40 as described below.

With continued reference to FIG. 4, the blade grip is attached such that the slip resistant outer surfaces 56 of the side members 48 are positioned where the medial phalange 36 of the index finger and distal phalange 60 of the thumb should be located. The location of the slip resistant outer surfaces 56 provides a visual indication of where to place the thumb and index finger. This visual indication aids persons in learning how to choke up. In addition, the slip resistant outer surfaces 56 allow the user to more easily move the knife blade in a longitudinal, slicing motion, as well as in an up-and-down motion. The slip resistant outer surfaces can also prevent slipping that may occur from the smooth and flat surface of the knife that is often coated by water, oils, juices, sauces, and other liquids common in the kitchen. The slip resistant outer surfaces have a higher coefficient of friction than other surfaces on the side members, which may be achieved by a rough textured area on the side member or tacky material bonded to, coated on, embedded into, or molded on the side member. Suitable tacky materials include, but are not limited to, silicone-based elastomers, which may also provide a soft cushion for comfort.

Referring now to FIG. 5, a side view of the blade grip 40 shows the slip resistant outer surface 56 on the side member 48 with a plurality of circular bumps or protrusions 62, which further prevent the thumb and index finger from slipping. Of course, other suitable types and shapes of protrusions may be employed for this purpose. Only one protrusion is indicated by a reference numeral to preserve the clarity of illustration. The overall proportion of the blade grip 40 is shown by a major dimension 64 running in the longitudinal direction and a minor dimension 66 running perpendicular to major direction. Preferably, the minor dimension or height of the blade grip is limited so as to allow the proximal portion of the knife blade near the knife handle 22 to be used to cut work pieces. At the same time, the major dimension or length of the blade grip 40 is preferably long enough to accommodate the thumb and index finger of a wide range of hand sizes. In particular, the length of the top member 42 should be sufficient to allow the proximal phalange 30 (FIG. 4) of the index finger to extend along and wrap over the rounded, top outer surface 46 of the top member 42. In view of these form factors, the ratio of the major dimension (length) to the minor dimension (height) is preferably at least about 3 to 1.

FIG. 6 shows a cross-sectional view taken along line 6-6 of FIG. 5. The blade grip 40 has a cross section that is substantially u-shaped with an inverted orientation such that the opening is adjacent to bottom portions 68 of the side members 48. In the illustrated embodiment, the bottom portions 68 are configured to form flared lips 72 that extend away from the opening. As such, the flared lips 70 facilitate attachment of the blade grip onto a knife blade 20 by guiding the top edge 34 of the knife blade into the opening adjacent the bottom portions. The side members are preferably biased inward toward the opening to exert a compressive force on the knife blade, thereby helping to prevent the blade grip from shifting in position after it is attached. Even when the side members 48 are biased, their side outer surfaces 52 remain substantially parallel to each other so as to conform to the parallel sides of the knife blade.

The overall physical proportion of the blade grip 40 is also shown by a width dimension 72 (FIG. 6) that runs in a transverse direction perpendicular to the length or major dimension 64 (FIG. 5). As previously mentioned, it is desirable that the blade grip closely conform to the shape of the knife blade so as to avoid interfering with desired thumb and index finger placements. To this end, the width dimension is preferably limited and small relative to the length dimension so as to allow the proximal phalange 30 of the index finger to remain substantially parallel to the longitudinal direction, when desired, while it is extends and wraps over the top outer surface 46 of the top member 42. Accordingly, the ratio of the length dimension to the width dimension is preferably at least about 8 to 1. In addition, as shown in FIG. 3, the width dimension is substantially uniform along the longitudinal direction.

Referring now to FIG. 7, a cut-away side view of the blade grip 40, taken along line 7-7 of FIG. 6, shows the side inner surface 50 of one of the side members 48. As previously mentioned, the side inner surface includes a slip resistant inner surface 54, which is positioned about the bottom portion 68 of the side member that exerts a compressive force on the knife blade 20 to keep the blade grip from shifting during normal use. The slip resistant inner surface has a higher coefficient of friction than other surfaces on the side member, which may be achieved with a thin, tacky material, such as a rubber-like elastomer that may be bonded on, embedded into, coated on, or molded into the side member. In the illustrated embodiment, the slip resistant inner surface includes a plurality of curved grooves 74 intended, in part, to allow liquids to drain away in order maintain friction between the blade grip and the knife blade.

As shown by the cut walls indicated by cross-hatch lines in FIGS. 6 and 7, the blade grip 40 preferably has walls that are thin relative to the overall proportions of the blade grip such that the blade grip conforms closely to the flat shape of the knife blade 20. To this end, the walls of the top member and side members are preferably substantially uniform in thickness. It will be appreciated by those skilled in the art that the configuration of the walls is well-suited for injection molding manufacturing processes since the blade grip may be made in a relatively simple two-half mold cavity with a single linear core pull. The substantially uniform wall thickness allows a molded part to cool quickly and uniformly to avoid warping and sinks, thereby reducing defects and increasing production mold cycle times. Because the design of the blade grip is suited to injection molding, it may be formed from a variety of plastic materials such as polyethylene, polypropylene, polycarbonate, ABS, acrylic, and nylon. Of course, other materials and molding or forming processes may also be used without departing from the scope of the invention. Preferably, the blade grip is made from a durable material that can withstand the high temperatures, abrasive agents, and chemicals of commercial dishwashing processes.

Figure 8:
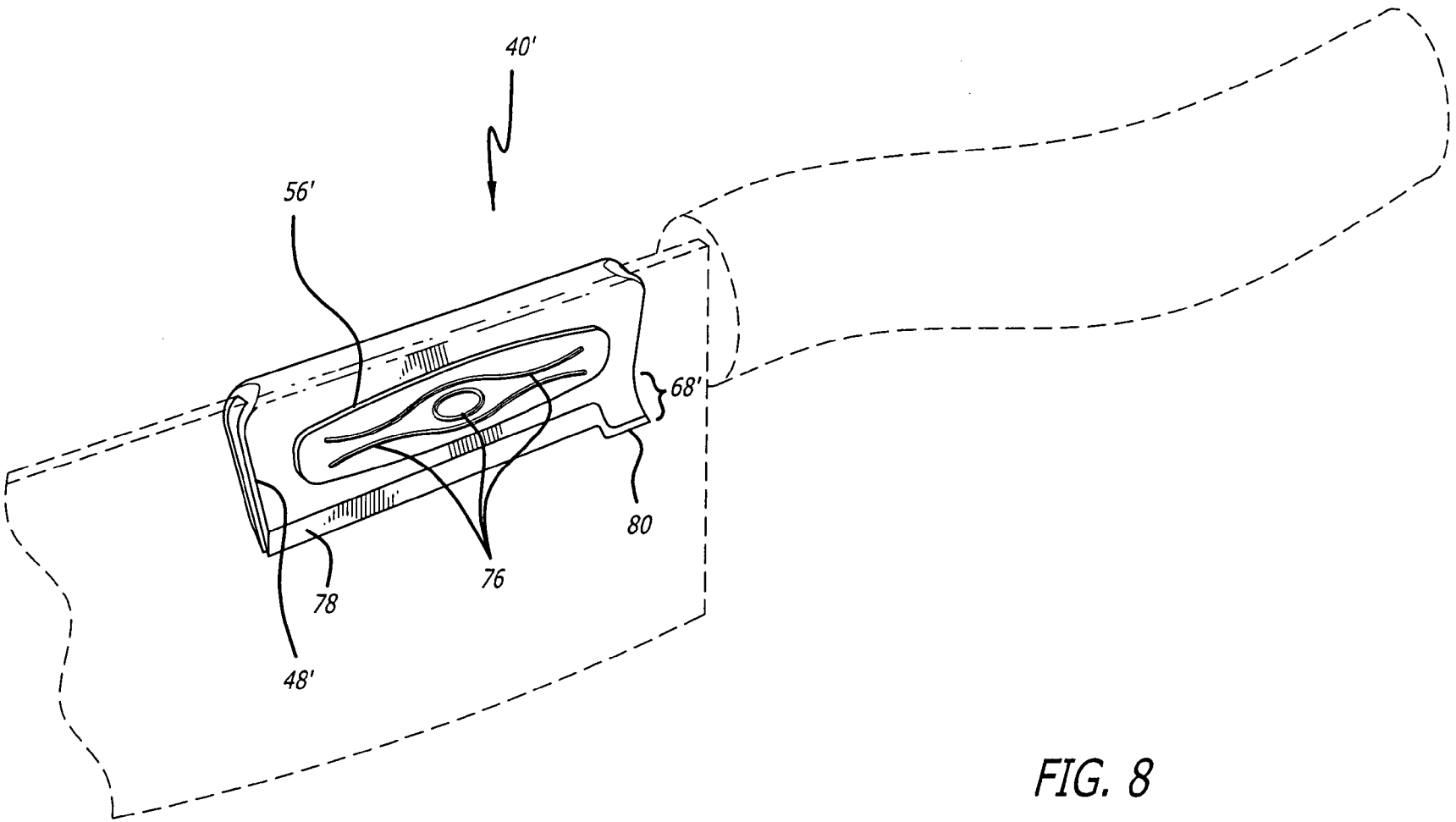
FIG. 8 is a top perspective view of a blade grip in accordance with an alternative embodiment of the present invention, showing the blade grip with chamfered side portions to guide a work piece away from the knife blade when cutting and flared corners to guide the top edge of the knife blade between the slide members when attaching the blade grip on to the knife blade.

FIG. 8 shows a blade grip 40' in accordance with another embodiment of the present invention. The slip resistant outer surface 56' on the side members 48' includes a plurality of curved grooves 76, which allow liquids to drain away in order to help maintain frictional contact between the blade grip and the thumb and index finger. Other suitable shapes and configurations of grooves, protrusions, and combinations thereof may also be employed for this purpose. One of the curved grooves forms a closed ellipsoid shape, which indicates a pinch point for the thumb or index finger. Such a visual indicator is especially useful when an instruction sheet for choking is included with the blade grip. In addition, the bottom portions 68' of the side members are chamfered or tapered inward along a substantial length 78 of the blade grip 40'. A work piece rising from below the chamfered bottom portion length 78 of blade grip would be guided away from the blade grip and avoids pushing the blade grip off the knife blade. The proximal end of the bottom portions nearest the handle has a flared corner 80 that extends outward to facilitate pushing the blade grip onto the knife blade when first attaching the blade grip onto the knife.

The benefits of greater control, efficiency, and safety may be achieved by using the blade grip with knives other than the standard chefs knife. Smaller and larger blade grips are contemplated to accommodate knives that are smaller and larger than the standard eight-inch and ten-inch chefs knife and to accommodate a wide variety of hands. Accordingly, the present invention is not intended to be limited to the embodiments described and illustrated.

While several particular forms of the invention have been illustrated and described, it will also be apparent that various modifications can be made without departing from the scope of the invention. It is also contemplated that various combinations or subcombinations of the specific features and aspects of the disclosed embodiments can be combined with or substituted for one another in order to form varying modes of the invention. Accordingly, it is not intended that the invention be limited, except as by the appended claims.

I claim:

1. A blade grip to be installed onto the top edge of a knife blade, the top edge extending distally from a knife handle in a longitudinal direction, the blade grip comprising:

an elongate top member having a top inner surface adapted to rest on the top edge of the knife blade and a top outer surface that is rounded in a transverse direction perpendicular to the longitudinal direction and is substantially coincident with the top edge of the knife blade;

two opposing side members extending longitudinally and connected to the top member, the side members each having a side inner surface adapted to grip one side of the knife blade and a side outer surface extending downward from the top outer surface of the top member, the side inner surface including a slip resistant inner surface and the side outer surface including a slip resistant outer surface, the slip resistant inner and outer surfaces having a higher coefficient of friction than other surfaces on the side members; wherein a bottom portion of at least one of the side members opposite the top outer surface includes a chamfer extending longitudinally along a substantial length of the at least one side member, and the bottom portion of the at least one side member includes a flared corner area extending beyond the chamfer.

2. The blade grip of claim 1, wherein the slip resistant outer surface on the at least one of the side members includes a plurality of curved grooves to allow liquids to drain away.

3. The blade grip of claim 1, wherein the side inner surface on the at least one of the side members includes at least one curved groove to allow fluid to drain away from the slip resistant inner surface.

4. The blade grip of claim 1, wherein the top member and the side members form a transverse cross-sectional shape substantially having an inverted "u" shape with an opening adjacent bottom portions of the side members.

5. The blade grip of claim 4, wherein the bottom portions of the side members are configured to form flared lips that lead the top edge of the knife blade into the opening adjacent the bottom portions.

6. The blade grip of claim 4, wherein the bottom portions are adapted to exert a compressive force on the knife blade.

7. The blade grip of claim 1, wherein the at least one of the side members has a length dimension in the longitudinal direction and a height dimension perpendicular to the length dimension, the ratio of the length dimension to the height dimension being at least about 3 to 1.

8. The blade grip of claim 1, wherein the at least one of the side members has a length dimension in the longitudinal direction and the top member has a width dimension perpendicular to the length direction, the ratio of the length dimension to the width dimension being at least about 8 to 1.

9. The blade grip of claim 1, wherein the top member has a substantially uniform wall thickness.

10. The blade grip of claim 1, wherein the side members have substantially uniform wall thicknesses.

11. The blade grip of claim 1, wherein the side outer surfaces are substantially parallel to each other.

12. The blade grip of claim 1, wherein the slip resistant surfaces include a rubber-like material.

13. A method of controlling a knife having a knife blade with a top edge extending distally from a knife handle in a longitudinal direction, the method comprising:

attaching a blade grip on to a knife blade, the blade grip including a top member and two opposing side members having side outer surfaces and side inner surfaces defining a longitudinal slot, including pushing the blade grip onto the top edge of the knife blade such that the top edge of the knife blade enters the longitudinal slot and rests upon the top member of the blade grip, and wherein the opposing side members have a substantially uniform wall thickness, and the side outer surfaces are substantially parallel;

grasping the knife with one hand, including:

wrapping the proximal phalange of the index finger over a rounded top surface of the top member and the medial phalange of a user's index finger is freely placed without interference on one side of blade grip when using the knife, and squeezing the side outer surfaces of the parallel side members between the medial phalange of the index finger and the distal phalange of user's thumb, so that the medial phalange of the index finger pushes against one of the parallel side outer surfaces of the blade grip to counterbalance pressure applied by the distal phalange of the thumb on the other of the parallel side outer surfaces of the blade grip when controlling the knife.

14. The method of claim 13, wherein the step of attaching the blade grip on to the knife blade includes positioning the blade grip along the top edge of the knife blade such that the blade grip is adjacent the knife handle.

15. The method of claim 13, wherein the blade grip includes slip resistant portions on the side outer surfaces and the medial phalange of the index finger and the distal phalange of the thumb squeeze the slip resistant portions on the side outer surfaces of the blade grip during the step of grasping the knife.

16. An apparatus comprising:

a knife having a knife blade;

a blade grip installed onto the top edge of the knife blade, the blade grip including:

an elongate top member having a top inner surface adapted to rest on the top edge of the knife blade and a top outer surface that is rounded in a transverse direction perpendicular to the longitudinal direction and is substantially coincident with the top edge of the knife blade;

two opposing side members extending longitudinally and connected to the top member, the side members each having a side inner surface adapted to grip one side of the knife blade and a side outer surface extending downward from the top outer surface of the top member, the side inner surface including a slip resistant inner surface and the side outer surface including a slip resistant outer surface, the slip resistant inner and outer surfaces having a higher coefficient of friction than other surfaces on the side members, and the side inner surface on at least one of the side members includes a groove to allow fluid to drain away from the slip resistant inner surface, and wherein the opposing side members have a substantially uniform wall thickness, and the side outer surfaces are substantially parallel.

17. The apparatus of claim 16, wherein the slip resistant inner surface includes a plurality of longitudinal slip resistant inner surfaces, and the groove is formed between the plurality of longitudinal slip resistant inner surfaces to allow fluid to drain away from the slip resistant inner surface when the blade grip installed on the knife blade.

18. The apparatus of claim 16, wherein the top member and the side members form an inverted U- shape with an opening adjacent bottom portions of the side members, the, and wherein the bottom portions of the side members form flared lips that lead the top edge of the knife blade into the opening adjacent the bottom portions, and the bottom portions are adapted to exert a compressive force on the knife blade.

19. The apparatus of claim 16, wherein at least one of the side members includes a flared corner area and a chamfer extending longitudinally along a substantial length of the at least one side member.

* * * * *